US006099363A

United States Patent [19]

Shirai et al.

[11] Patent Number: 6,099,363

[45] **Date of Patent: *Aug. 8, 2000**

[54] ELECTRICAL CONNECTOR

[75] Inventors: Hiroshi Shirai, Saitama; Hiroyuki Okazaki, Kanagawa, both of Japan

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/288,605

[22] Filed: Apr. 8, 1999

[30] Foreign Application Priority Data

Apr. 14, 1998 [JP] Japan ..... 10-101624

[51] Int. Cl.[7] ..... H01R 4/50

[52] U.S. Cl. ..... 439/863

[58] Field of Search ..... 439/863, 387, 439/393; 310/71; 336/192

[56] References Cited

U.S. PATENT DOCUMENTS

| | | | |
|---|---|---|---|
| 3,730,972 | 5/1973 | Hennessey | 174/94 R |
| 4,026,013 | 5/1977 | Hughes | 29/628 |
| 4,152,686 | 5/1979 | Hughes | 336/192 |
| 4,166,265 | 8/1979 | Reynolds et al. | 336/192 |
| 4,183,607 | 1/1980 | Hughes | 339/97 R |
| 5,217,396 | 6/1993 | Castanga et al. | 439/751 |
| 5,447,455 | 9/1995 | Plosser | 439/863 |

FOREIGN PATENT DOCUMENTS

| | | | |
|---|---|---|---|
| 10-69929 | 3/1998 | Japan | H01R 4/48 |
| WO 98/38698 | 9/1998 | WIPO | H01R 4/24 |

*Primary Examiner*—Lincoln Donovan
*Assistant Examiner*—Chandrika Prasad

[57] ABSTRACT

Electrical connector (1) comprising a first contact member (10) having an arcuate contact surface **(14*a*) that engages an electrical wire (3), a second contact member (40) has a connecting portion (50) and a pressing portion (48) that presses a free end (30) of the contact section (14). Insulating housing (60) has a first cavity (62) in which a wire-engaging surface (74) is located, and a second cavity (66) which communicates with the first cavity (62). When the first contact member (10) is inserted into the first cavity (62) and the second contact member (40) is press-fitted in the second cavity (66) in a state in which the electrical wire 3 is disposed between the wire-engaging surface (74) and the contact section (14), the pressing portion (48) presses the free end (30) so that the contact section (14) is caused to make electrical connection with the electrical wire (3)**.

10 Claims, 5 Drawing Sheets

ELECTRICAL CONNECTOR

FIELD OF THE INVENTION

The present invention relates to an electrical connector, and more specifically it relates to an electrical connector for terminating fine wires such as coil windings and the like.

BACKGROUND OF THE INVENTION

Fine wire electrical connections in which insulated electrical wires are press-fitted in slots of electrical contacts are universally known as a technique for terminating insulated electrical wires without stripping insulation from the wires beforehand. However, in cases where extremely fine coil windings such as, e.g., fine wires having an AWG of 50 are terminated in such contacts, not only do the coil windings tend to break, but it is also extremely difficult to form narrow slots corresponding to the diameters of the coil windings into the contacts, into which the wires are press-fitted. Accordingly, one such previously described electrical connector 100 that is shown in FIGS. 11 and 12, is disclosed in Japanese Patent Publication No. 10-69929 for terminating fine electrical wires.

Electrical connector 100 comprises an insulating housing 150 having a cavity 152, and an electrical contact 110, which is inserted into cavity 152. Contact 110 has an external connecting section 112, which electrically connects with an external terminal (not shown), a press-fitting section 114, and an arcuate-shaped contact section 116 on which is located a serrated surface having contact points 116*a* that bite into an insulated electrical wire 3. A linear transition section 122 is disposed between the press-fitting section 114 and contact section 116 via a first bent section 124 and a second bent section 126. When the contact 110 is pressed downward by means of a tool 172 in engagement with the press-fitting section 114 so that the contact 110 is forcibly moved in a direction substantially perpendicular to the direction of insertion of the contact 110, the portion of the contact section 116 located in the vicinity of the second bent section 126, is driven against an inner tapered surface 160 of the cavity 152 as shown in FIG. 12. As a result, a secure electrical connection is obtained between the contact 110 and the insulated electrical wire 3.

In the contact 110 of electrical connector 100, a large amount of bending in the first bent section 124 and second bent section 126 takes place; accordingly, stress tends to concentrate in the bent sections. As a result, there is a danger that cracking will occur in the bent sections. Furthermore, since the contact 110 is a single integral member equipped with the connecting section 112 and contact section 116, the force applied to the connecting section 112 during the connection and disconnection of the external terminal with the connecting section 112, is transmitted directly to the contact section 116, thereby causing fluctuations in the contact points between the electrical wire 3 and contact section 116, so that there is a danger that the reliability of the electrical connection therebetween will be lowered. Furthermore, in the connected state shown in FIG. 12, portions of the contact 110 other than the contact section 116 lack flexibility; accordingly the dimensional tolerance in the horizontal direction between the first and second bent sections 124 and 126 is small. In response to this, strict dimensional control of the cavity 152 of the housing 150 in the horizontal direction is necessary; consequently, manufacture of the housing 150 is difficult.

International Publication No. W098/38698 discloses an electrical connector comprising a housing having first and second cavities that communicate with each other, a first contact member having a contact section that is press-fitted into the first cavity and an arcuate contact section that extends along a wire-engaging surface of the first cavity, and a second contact member that is press-fitted into the second cavity. When an insulated electrical wire is disposed between the wire-engaging surface and the arcuate contact section, and the second contact member is press-fitted into the second cavity, a pressing portion of the second contact member presses arcuate contact section toward the wire-engaging surface so that sawtooth-shaped serrations of the arcuate contact section make electrical connection with the insulated electrical wire.

The first contact member is not stabilized within the first cavity. Thus, during connection of a connecting section of the first contact member with a mating contact member or disconnection therefrom, the electrical connection between the arcuate contact section and the electrical wire can be disrupted.

SUMMARY OF THE INVENTION

Accordingly, an object of the present invention is to provide an electrical connector which solves the abovementioned problems, specifically, an electrical connector in which there is little tendency for internal stress to concentrate in electrical contact members during press-fitting within a cavity of a housing, in which there tends to be no fluctuation in contact points between an electrical wire and a contact section during electrical connection of the electrical contact with a mating electrical contact, and in which the electrical contact members are relatively easy to manufacture.

The electrical connector of the present invention comprises an insulating housing having a first cavity provided with a wire-receiving surface, and a second cavity in communication with the first cavity, a first contact member having a base portion that is press-fitted inside the first cavity, and an arcuate contact section at one end of the base section having a convex surface facing the wire-receiving surface, and a second contact member having a base section that is press-fitted inside the second cavity, a pressing portion on the base portion, and a connecting portion on one end of the base portion; an electrical wire is disposed between the wire-receiving surface and the convex surface of the contact section, and the pressing portion presses a point located in the vicinity of the free end of the contact section on an opposite side of the contact section from the convex surface, so that the contact section is caused to resiliently engage the wire.

An arcuate surface is convex in an opposite direction from the convex surface in the vicinity of a free end of the contact section of the first contact member.

A supporting arm which supports the base section of the first contact member is located on the second contact member.

An electrical connector comprises a dielectric housing having a wire-engaging surface along which an insulated electrical wire extends; a first cavity in the housing; a first electrical contact member movable along the first cavity and having an arcuate-shaped contact section having a serrated surface for engagement with the insulated electrical wire; a second cavity in the housing; a second electrical contact member movable along the second cavity including a pressing portion for engaging a free end of the arcuate-shaped contact section for moving the serrated surface into electrical connection with the insulated electrical wire so that the insulated electrical wire is disposed between the serrated surface and the wire-engaging surface; and a supporting arm extending between the first electrical contact member and the second electrical contact member adjacent an outer end of the arcuate-shaped contact section.

BRIEF DESCRIPTION OF THE INVENTION

Embodiments of the present invention will now be described by way of example with reference to the accompanying drawings, in which.

Figure 12:
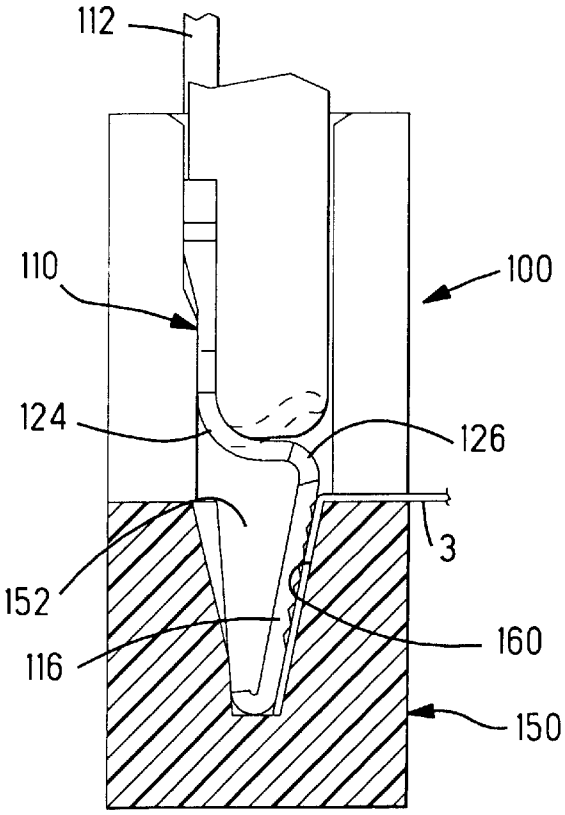
FIG. 12 Prior Art
Figure 11:
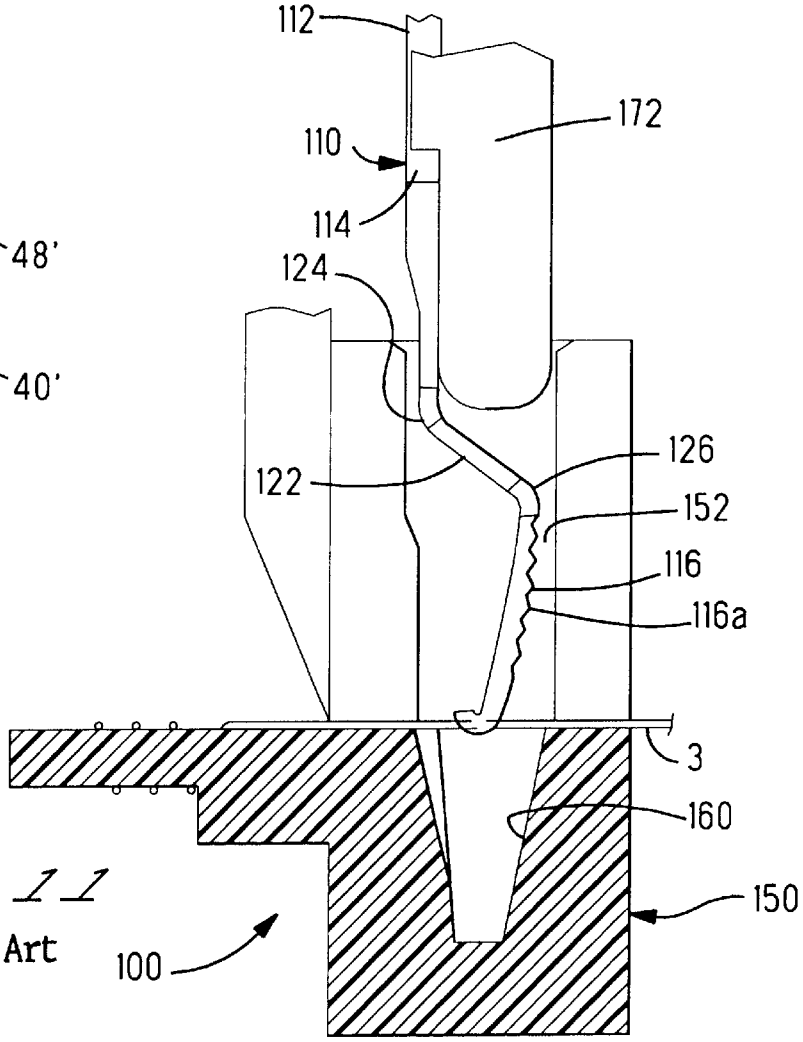
FIG. 11 Prior Art

FIG. 11 is a cross-sectional view showing the state at an intermediate point during the insertion of a contact into a cavity of a housing of a conventional electrical connector with an electrical wire extending across the cavity; and FIG. 12 is a cross-sectional view showing the state of a completed electrical connection between the contact and the electrical wire of the electrical connector of FIG. 11.

DETAILED DESCRIPTION OF THE INVENTION

Figure 1:
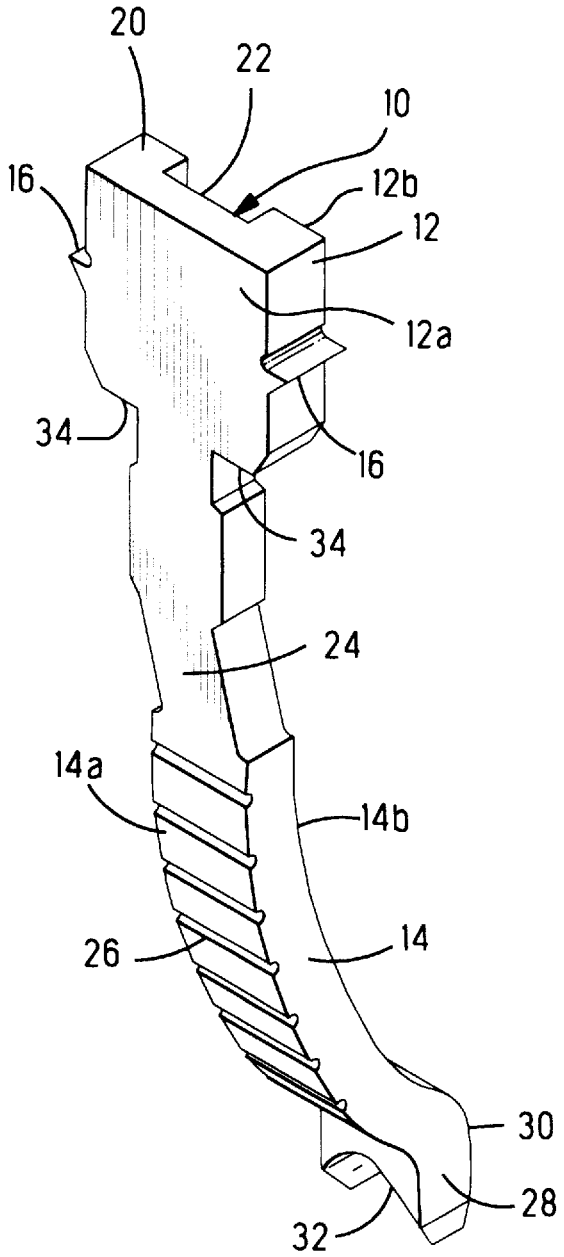
FIG. 1 is an isometric view showing a first contact member of an electrical connector of the present invention.
Figure 2:
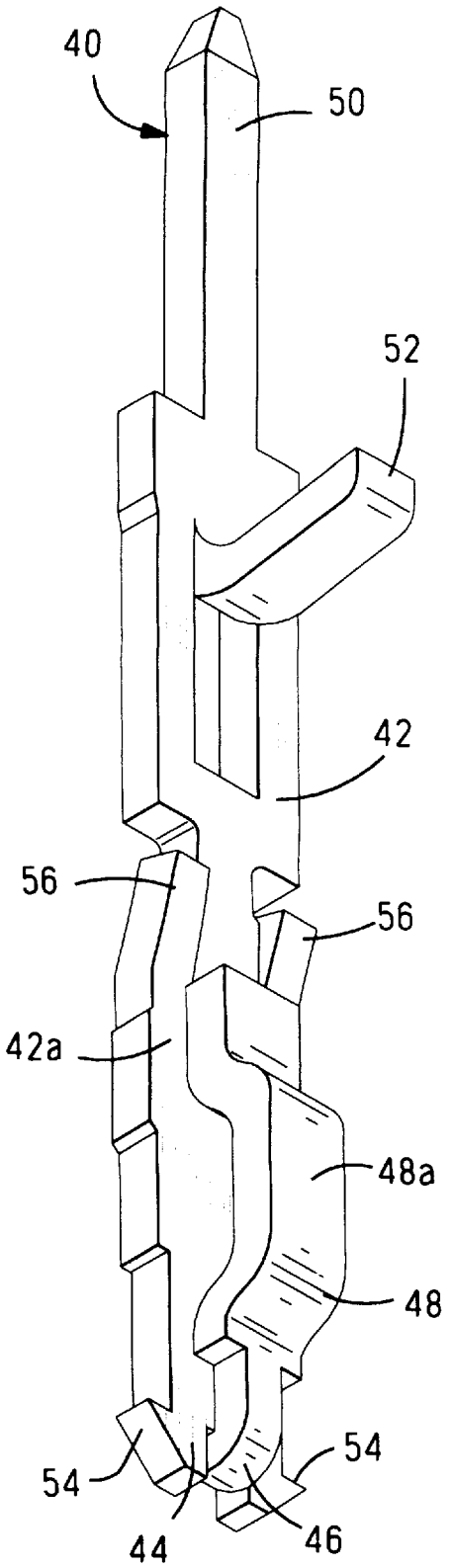
FIG. 2 is an isometric view showing a second contact member of the electrical connector of FIG. 1.
Figure 3:
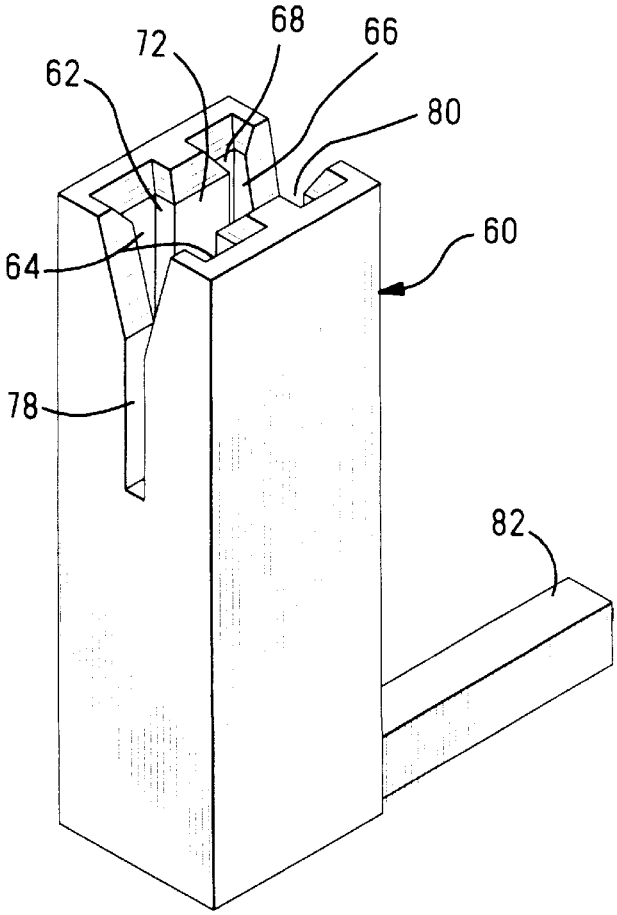
FIG. 3 is an isometric view showing a housing of the electrical connector of FIGS. 1 and 2.

In FIGS. 1 through 3, electrical connector 1 of the present invention (see FIG. 9) comprises first and second contact members 10,40. First contact member 10 engages an insulated electrical wire 3 that is covered with a very hard covering such as enamel, and second contact member 40 presses the first contact member 10 in electrical engagement with the insulated electrical wire 3. Housing 60 accommodates the first contact member 10 and second contact member 40.

The first contact member 10 shown in FIG. 1 is preferably formed by stamping and forming a copper alloy metal plate which has a high degree of resiliency, such as phosphorus bronze or beryllium copper. The first contact member 10 has a base section 12, which has a flat surface 12*a*, and a contact section 14, which is disposed at one end of base section 12 and which is used to make an electrical connection with insulated electrical wire 3. A pair of barbs 16 are located on both side surfaces of the base section 12. When the first contact member 10 is inserted into a first cavity 62 (see FIG. 3) of the housing 60, the barbs 16 bite into inside walls 64 of the first cavity 62, so that the first contact member 10 is held inside the first cavity 62. A substantially flat tool-engaging surface 20 is located on the other end of the base section 12. A tapered groove 22 facilitates engagement of a supporting arm 52 of the second contact member 40, and it is located in a surface 12*b* on an opposite side of the base section 12 from the flat surface 12*a*, the entrance to tapered groove 22 is at the tool-engaging surface 20.

The contact section 14 is offset from the surface 12*a* of the base section 12 by a first bent section 24, the longitudinal shape of which is substantially a gradual curve; furthermore, the contact section 14 has a substantially gradual arcuate shape in which surface 14*a* is convex. The first bent section 24 has narrower dimensions than the other portions of the contact section 14 in order to increase the flexibility thereof. Numerous sawtooth-shaped contact serrations 26, which pierce the insulation of the insulated electrical wire 3 and electrically engage the conductor of the electrical wire 3, are located on an intermediate portion of the convex surface 14*a* of the contact section 14. A second bent section 28 is located at a free end of the contact section 14, and has a longitudinal shape that is substantially curved. Apical section 30 of the second bent section 28 on surface 14*b* of the contact section 14 has an arcuate shape which is convex in the opposite direction from the surface 14*a*. As will be described later, apical section 30 is a force point which is pressed against the second contact member 40. As a result of the apical section 30 being formed with an arcuate shape, engagement with a pressing portion 48 (see FIG. 2) of the second contact member 40 is made smoother. A substantially V-shaped cut-out 32 is located in the free end of the second bent section 28. The cut-out 32 guides the electrical wire 3 during the press-fitting of the second contact member 40 into the housing 60. The shape of the cut-out 32 may be a different shape such as a U-shape.

The second contact member 40 shown in FIG. 2 is formed by stamping and forming a copper alloy plate which has a conductivity equal to or greater than that of the first contact member 10. The second contact member 40 has a flat plate base portion 42, pressing portion 48, which is bent approximately 180° via a bent portion 46 in the vicinity of one end 44 of the base portion 42 and which extends along the base portion 42, and a connecting portion 50, which is disposed at the other end of the base portion 42 and which makes electrical connection with a mating electrical contact. Supporting arm 52 is bent at an acute angle and which extends to one side and is disposed on the base portion 42. Barbs 54 on both sides of one end 44 of the base portion 42 bite into inside walls 68 (see FIG. 3) of a second cavity 66 of the housing 60. Lances 56, which bite into inside wall 70 (see FIG. 6) of the second cavity 66 of the housing 60, are cut out and extend inwardly on both sides of the approximate center of the base portion 42. Pressing surface 48*a* is an outer surface of the pressing portion 48 and is offset from surface 42*a* of the base portion 42. The connecting portion 50 is a post which is rectangular in cross section; however, connecting portion 50 may be any universally-known connecting means such as a post with a round cross section.

Figure 4:
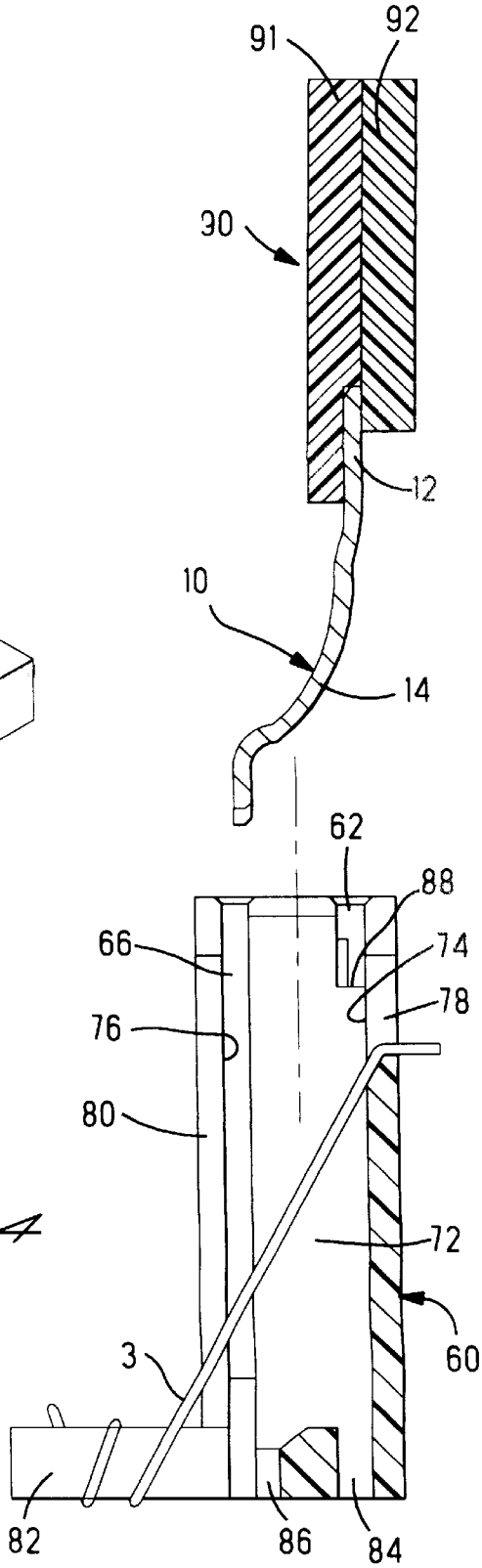
FIG. 4 is a cross-sectional view showing the state prior to the insertion of the first contact member into the first cavity of the housing of the connection process of the electrical connector of FIGS. 1 to 3 with an electrical wire.

The housing 60 shown in FIGS. 3 and 4 is preferably molded from an insulating material such as PBT containing glass fibers, and it is either formed as an integral unit with the housing of a motor or coil bobbin (not shown), or formed alone. The housing 60 overall has the shape of a rectangular parallelepiped, and it has first cavity 62 that accommodates the first contact member 10, second cavity 66 that accommodates the second contact member 40, and a narrow intermediate cavity 72, which enables the first and second cavities 62,66 to communicate with each other. A first electrical wire-accommodating slot 78 is located in outside wall 74 of the first cavity 62 of the housing 60, and a second electrical wire-accommodating slot 80 is located in outside wall 76 of the second cavity 66. The wall 74 constitutes an engaging surface for the electrical wire 3, and the wall 76 constitutes an engaging surface for the second contact member 40. Walls 74,76 are parallel to one another. The second slot 80 is longer than the first slot 78. A post 82 around which an end of the electrical wire 3 is wrapped is located as a projection in the vicinity of the lower end of the second slot 80. A through-hole 84 allows visual confirmation of whether or not the connection of the first contact member 10 and electrical wire 3 has been achieved, and is located in a bottom wall of the housing in communication with the first cavity 62. Furthermore, a relief hole 86, which accommodates the bent portion 46 at an inner end of the second contact member 40, is located in the bottom wall of the housing in communication with the second cavity 66. Relief hole 86 need not pass all the way through the bottom wall of the housing 60.

Next, the process by which the electrical connector 1 and electrical wire 3 are electrically connected to each other will be described with reference to FIGS. 4 through 9. The end of electrical wire 3 extending from a coil bobbin (not shown) is wrapped beforehand around the post 82 of the housing 60, and electrical wire 3 is thus fastened to the housing 60 in a state in which wire 3 passes through the first and second slots 78,80 across cavities 62,66,72. Next, the first contact member 10 is clamped by means of first portion 91 and second portion 92 of a first press-fitting tool 90.

Figure 5:
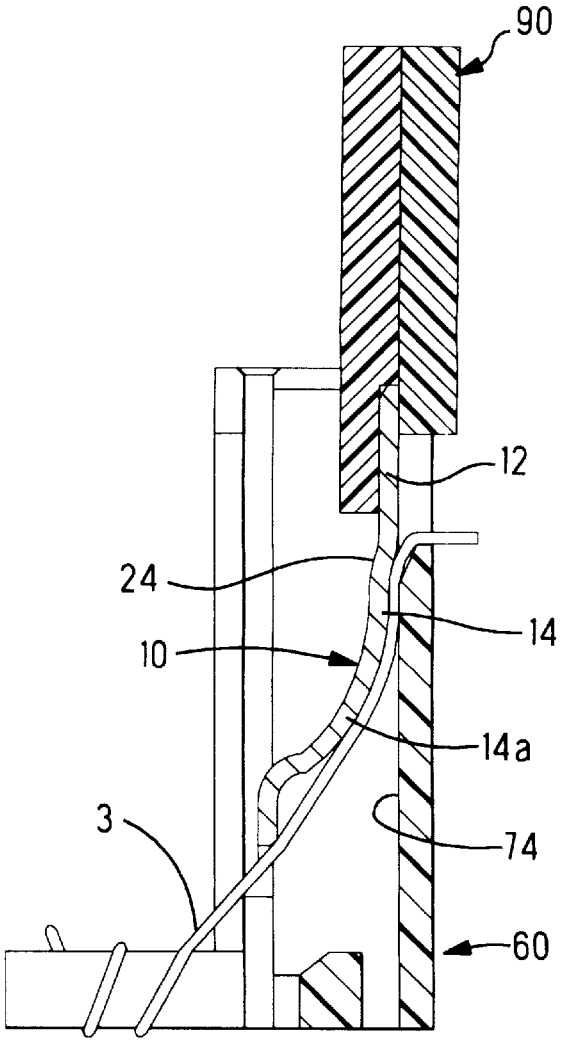
FIG. 5 is a cross-sectional view similar to FIG. 4 showing the state at an intermediate state during the insertion of the first contact member into the first cavity of the housing.

Then, as shown in FIG. 5, the first contact member 10 is inserted into the first cavity 62 of the housing 60 until the shoulder 34 (see FIG. 1) of the base section 12 of the first contact member 10 engages stop surface 88 (see FIG. 4) of the first cavity 62. During the insertion of the first contact member 10, the cut-out 32 of the first contact member 10 moves along the electrical wire 3 and the electrical wire 3 is disposed substantially along the convex surface 14*a* of the contact section 14. Furthermore, in the state shown in FIG. 5, since the first bent section 24 of the first contact member 10 is offset from the base section 12, the contact section 14 is separated from the wire-engaging surface 74 of the housing 60 by an amount equal to or greater than the diameter of the electrical wire 3, and the serrations 26 (see FIG. 1) do not at this point apply any load to the electrical wire 3. Accordingly, no cutting of the electrical wire 3 by the first contact member 10 takes place.

Figure 6:
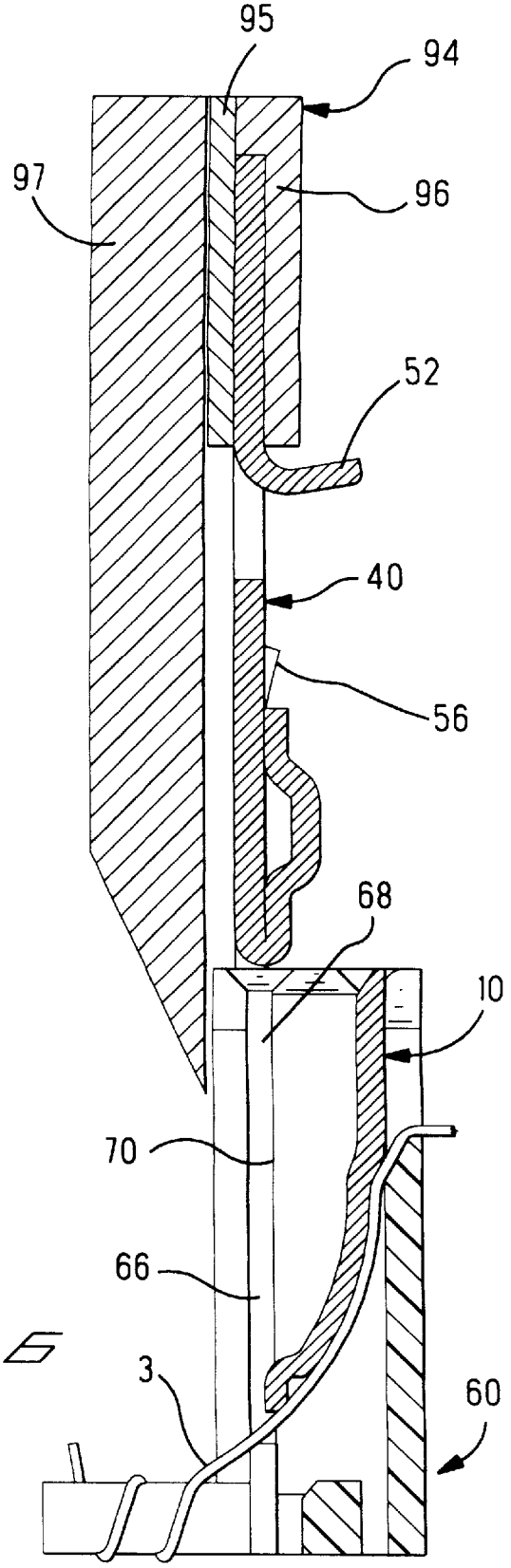
FIG. 6 is a cross-sectional view showing the state prior to the insertion of the second contact member into the second cavity of the housing.

Next, as shown in FIG. 6, the second contact member 40 is clamped by first portion 95 and second portion 96 of a second press-fitting tool 94, and the second contact member 40 is inserted into the second cavity 66 of the housing 60. The second press-fitting tool 94 moves as an integral unit with cutting blade 97.

Figure 9:
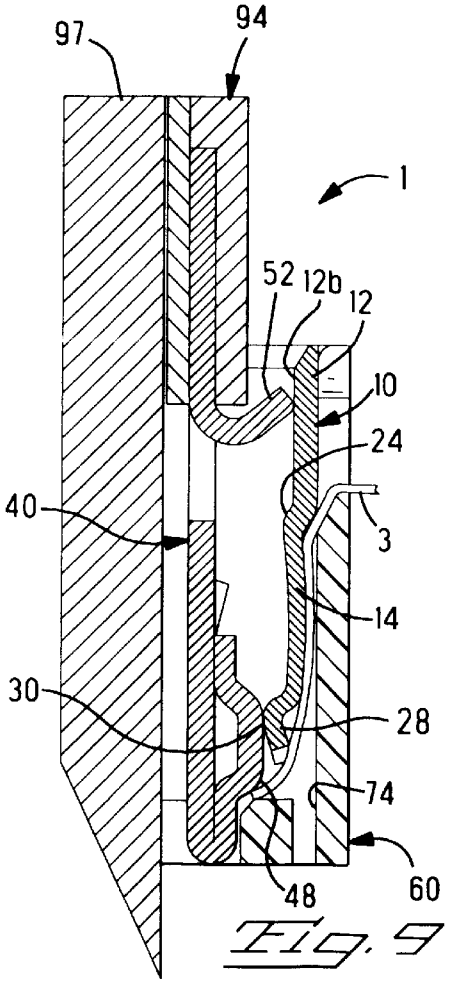
FIG. 9 is a cross-sectional view showing the state of the completed electrical connection between the first contact member and the electrical wire.
Figure 8:
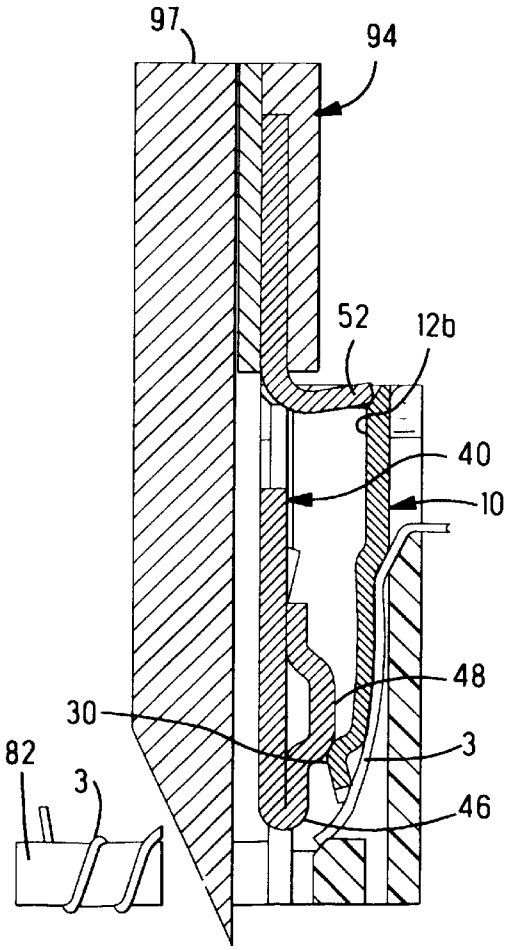
FIG. 8 is a cross-sectional view showing the state at an intermediate point during the insertion of the second contact member into the second cavity of the housing.
Figure 7:
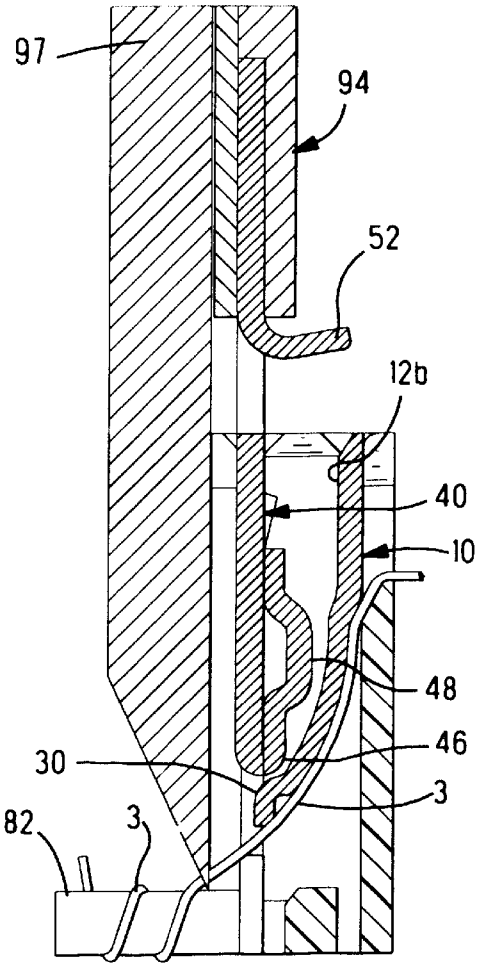
FIG. 7 is a cross-sectional view showing the state at an intermediate point during the insertion of the second contact member into the second cavity of the housing.

As the insertion of the second contact member 40 by means of the second press-fitting tool 94 is carried out, the bent portion 46 of the second contact member 40 engages the apical section 30 of the first contact member 10 as shown in FIG. 7, and at the same time, the cutting blade 97 cuts into the electrical wire 3. The electrical wire 3 and post 82 are then cut. As a result, no forced cutting of the electrical wire 3 as a result of the lowering of the second contact member 40 takes place. When the bent portion 46 of the second contact member 40 engages the apical section 30 of the first contact member 10, the second bent section 28 of the first contact member 10 is pushed toward the wire-engaging surface 74 of the housing 60, When the downward pressing of the second contact member 40 by means of the second press-fitting tool 94 is carried out, the pressing portion 48 of the second contact member 40 rides over the apical section 30, so that the apical section 30 and pressing portion 48 are engaged as shown in FIG. 9. In this engaged state, the first bent section 24 of the first contact member 10, which has increased flexibility as a result of being formed with a narrow width, is resiliently deformed; furthermore, the contact section 14 of the first contact member 10 is resiliently deformed into a substantially linear shape. As a result, the electrical wire 3 is clamped between the contact section 14 of the first contact member 10 and the wire-engaging surface 74 of the housing 60. If the lower end of the base section 12 of the first contact member 10 (between the base section 12 and the first bent section 24) is taken as the supporting point, and the apical section 30 is taken as the force point, then the serrations 26 of the contact section 14 are taken as the action points. Thus, according to the principle of a lever, the load applied to the electrical wire 3 by the serrations 26 is extremely large. In addition, the supporting arm 52 of the second contact member 40 supports the surface 12*b* of the base section 12 of the first contact member 10; accordingly, the separation of the base section 12 side of the first contact member 10 from the wall 74 of the housing 60, is prevented by the moment created by the engagement of the apical section 30 of the first contact member 10 and the pressing portion 48 of the second contact member 40, so that the engagement pressure of the serrations 26 onto the electrical wire 3 is assured. Accordingly, the reliability of the electrical connection between the electrical wire 3 and the first contact member 10 is very high.

The height to which the serrations 26 protrude from the surface 14*a* of the contact section 14 is considerably smaller than the diameter of the electrical wire 3, and the tip end of the contact section 14 describes a track of movement in a direction substantially perpendicular to the axis of the electrical wire 3; thus, there is no danger that the electrical wire 3 will be cut by the deformation of the first contact member 10. The end of the electrical wire 3 cut by the cutting blade 97 is guided by the cut-out 32 in the first contact member 10; in the final state shown in FIG. 9, the wire end is appropriately disposed between the wire-engaging surface 74 and the contact section 14. As was mentioned above, it is possible to confirm via the through-hole 84 whether or not the electrical wire 3 is appropriately disposed between the wire-engaging surface 74 and contact section 14.

In the present invention, the amount of bending is relatively small in both the first contact member 10 and second contact member 40, so that the resilient region is not exceeded. Accordingly, highly reliable electrical connections are obtained. Furthermore, the contact section 14 of the first contact member 10 is formed in arcuate shape, and it has sufficient flexibility, minimizing any need for a strict horizontal dimensional tolerance in the cavities of the housing 60. In addition, since the connector does not have a structure in which the first contact member 10 and second contact member 40 abut on the bottom walls of the cavities of the housing 60, the housing 60 does not require a high strength. Moreover, since the connecting portion 50 is on the second contact member 40 rather than on the first contact member 10 which engages the electrical wire 3, there is very little danger that the points of contact between the serrations 26 and electrical wire 3 will fluctuate according to the force applied during connection with or disconnection from mating contacts of the connecting portion 50. In addition, the first contact member 10 is supported by the supporting arm 52 of the second contact member 40, so that the separation of the base section 12 from the inside surface 74 of the housing 60 is prevented. As a result, this contributes to an even higher reliability of electrical connection.

Figure 10:
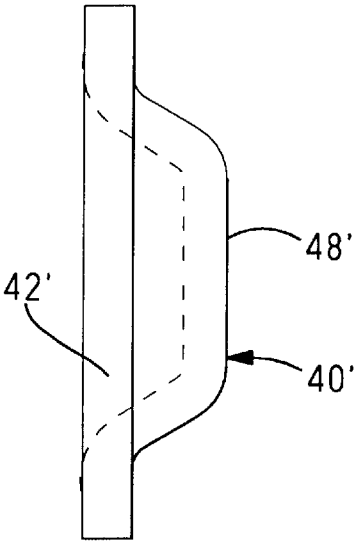
FIG. 10 shows a tip end portion of an alternative embodiment of the second contact member.

The present invention has been described above; however, the present invention is not limited to the embodiment described above. It goes without saying that various modifications and alterations may be made if necessary. For example, instead of forming the pressing portion 48 of the second contact member 40 by means of a bent portion 46 bent approximately 180°, it would also be possible to form pressing portion 48', which is offset from the base portion 42', by deep drawing or embossing as shown in FIG. 10 so as to form a projection. In this case, since there is no bending process involving a large amount of bending such as a 180° bend, the following advantages are obtained: namely, the die used to form the second contact member 40' is not complicated, and the manufacture of the second contact member 40' is much easier.

In the electrical connector of the present invention, the amount of bending is relatively small in both the first and second contact members, so that the resiliency is not exceeded Accordingly, no excessive internal stresses are generated in the contact members. As a result, there is very little danger of cracking in the first and second contact members. And, since the connecting portion is on the second contact member rather than on the first contact member which engages the electrical wire, there is very little danger that the points of contact between the serrations and electrical wire will fluctuate according to the force applied during connection with or disconnection from of the connecting portion with mating contact members. The contact section of the first contact member is formed in an arcuate shape, and it has sufficient flexibility; accordingly, there is no need for a strict horizontal dimensional tolerance in the cavities of the housing.

An arcuate surface, which is convex in the opposite direction from the convex surface of the contact section of the first contact member, is formed in the vicinity of the free end of the contact section, facilitating the smooth insertion of the second contact member for the purpose of pressing the free end of the contact section of the first contact member.

A supporting arm is located on the second contact member that supports the base section of the first contact member; the first contact member is supported by the supporting arm so that the separation of the base section of the first contact member from the wire-engaging surface of the housing is prevented. As a result, this contributes to an even higher reliability of the electrical connection.

What is claimed is:

1. An electrical connector comprising:

a dielectric housing having a wire-engaging surface along which an insulated electrical wire extends;

a first cavity in the housing;

a first electrical contact member movable along the first cavity and having an arcuate-shaped contact section provided with a serrated surface for engagement with the insulated electrical wire;

a second cavity in the housing;

a second electrical contact member movable along the second cavity including a pressing portion for engaging a free end of the arcuate-shaped contact section for moving the serrated surface into electrical connection with the insulated electrical wire so that the insulated electrical wire is disposed between the serrated surface and the wire-engaging surface; and a supporting arm extending between the first electrical contact member and the second electrical contact member adjacent an outer end of the arcuate-shaped contact section.

2. An electrical connector as claimed in claim 1, wherein the first electrical contact member includes a base section having barbs for securing the first electrical contact member in the first cavity.

3. An electrical connector as claimed in claim 2, wherein a bent section is located between the arcuate-shaped contact section and the base section and is narrower than the arcuate-shaped contact section and the base section thereby increasing the flexibility of the arcuate-shaped contact section.

4. An electrical connector as claimed in claim 1, wherein the free end of the arcuate-shaped contact section has a convex shape in an opposite direction to a convex shape of the arcuate-shaped contact section.

5. An electrical connector as claimed in claim 4, wherein the free end has a V-shaped cut-out.

6. An electrical connector as claimed in claim 2, wherein the supporting arm extends outwardly from a base portion of said second electrical contact member and engages a tapered groove in the base section of the first electrical contact member.

7. An electrical connector as claimed in claim 1, wherein the pressing portion is bent from a bent portion at an inner end of a base portion so that the pressing portion extends along the base portion.

8. An electrical connector as claimed in claim 1, wherein the pressing portion is a projection extending outwardly from a base portion.

9. An electrical connector as claimed in claim 1, wherein a first slot is located in an outside wall of the first cavity and a second slot is located in an outside wall of the second cavity so that the insulated electrical wire is disposed in the first and second slots across the first and second cavities.

10. An electrical connector as claimed in claim 9, wherein a post extends outwardly from the outside wall of the second cavity around which an end of the insulated electrical wire is wound.

* * * * *